United States Patent [19]

Bastenhof

[11] 4,195,610

[45] Apr. 1, 1980

[54] METHOD AND DEVICE FOR STOPPING A FUEL-INJECTION INTERNAL COMBUSTION ENGINE IN CASE OF OVERSPEED

[75] Inventor: Dirk Bastenhof, Eaubonne, France

[73] Assignee: Societe d'Etudes de Machines Thermiques S.E.M.T., Saint-Denis, France

[21] Appl. No.: 924,287

[22] Filed: Jul. 13, 1978

[30] Foreign Application Priority Data

Sep. 23, 1977 [FR] France ..... 77 28798

[51] Int. Cl.[2] ..... F02B 77/08

[52] U.S. Cl. ..... 123/139 AZ; 123/198 D; 123/198 DB

[58] Field of Search ..... 123/198 F, 139 AZ, 198 D, 123/198 DB

[56] References Cited

U.S. PATENT DOCUMENTS

| | | | |
|---|---|---|---|
| 3,926,163 | 12/1975 | Bastenhof | 123/139 AZ |
| 3,989,022 | 11/1976 | Pfister | 123/198 DB |
| 4,071,010 | 1/1978 | Miller | 123/139 AZ |
| 4,092,965 | 6/1978 | Lintott | 123/198 DB |
| 4,108,129 | 8/1978 | Rognon | 123/198 DB |

FOREIGN PATENT DOCUMENTS

| | | | |
|---|---|---|---|
| 2364969 | 7/1975 | Fed. Rep. of Germany | 123/139 AZ |
| 498404 | 4/1976 | U.S.S.R. | 123/139 AZ |

*Primary Examiner*—Ira S. Lazarus

*Attorney, Agent, or Firm*—Kenyon & Kenyon

[57] ABSTRACT

A method and a device for stopping a fuel-injection internal combustion engine, in which the injection pump is of the multi-cylinder single-housing type, comprising in supplying the housing of the pump with pressurized gas for separating the pump plungers and tappets from their actuating cams.

7 Claims, 1 Drawing Figure

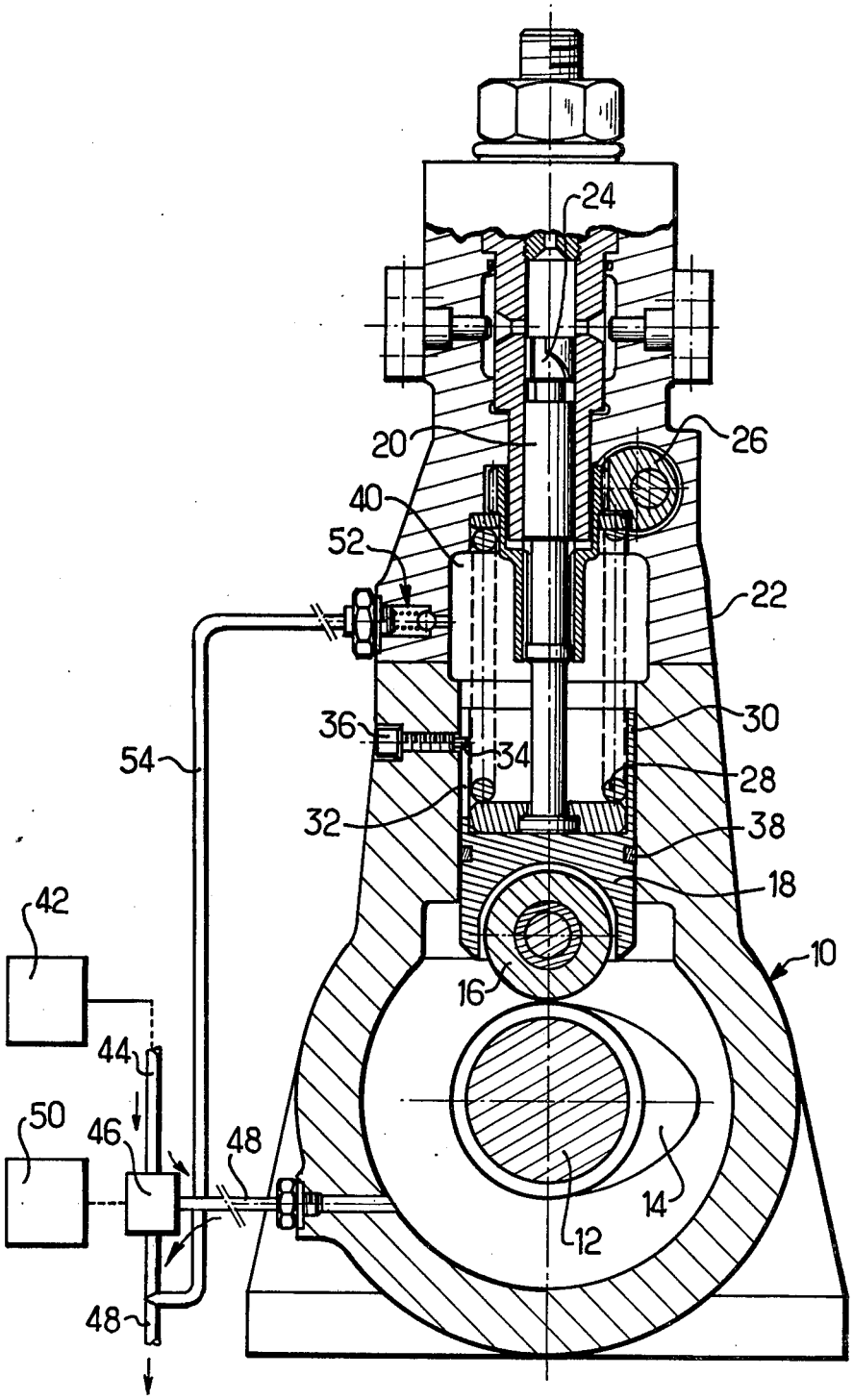
24
20
26
40
52
22
36
30
54
34
28
32
38
18
42
10
16
44
50
46
48
14
12
48

METHOD AND DEVICE FOR STOPPING A FUEL-INJECTION INTERNAL COMBUSTION ENGINE IN CASE OF OVERSPEED

The present invention relates generally to a method and a device for emergency stopping of a fuel-injection internal combustion engine.

There is already known a method of emergency stopping of a fuel-injection internal combustion engine in case of over-speed, which is applied to an engine comprising fuel injection pumps of the constant-stroke reciprocating plunger type, wherein a base member or piston slidably mounted in the pump body and interposed between the plunger and its operating tappet defines in the pump body two separate closed chambers, one of which contains the plunger whereas the second contains the tappet, and the said method consisting in case of engine overspeed, in supplying a compressed gaseous fluid such as air or preferably a compressed inert gas to the said second chamber under a sufficient pressure to disengage and separate in a known manner the base member and therefore the plunger from the tappet, to thereby stop the corresponding injection pump.

Also known is a device allowing the above method to be carried out and which comprises means permitting the supply to the said second chamber of a compressed gaseous fluid such as air or preferably of a compressed inert gas, under a sufficient pressure to disengage and separate in a known manner the plunger from its operating tappet to thereby stop each fuel-injection pump. According to another characterizing feature of the device, the compressed gas supply means comprise a source of compressed gas connected through an overspeed-sensitive tripping device to a line for the recovery of leakage fuel in the second chamber.

The known technique just described therefore consists essentially, in case of engine overspeed, in supplying compressed gas to each fuel-injection pump to cause the pressure of the compressed gas to react upon the base member or piston of the injection pump plunger so as to lift the plunger and separate it from its operating tappet to thereby stop the corresponding injection pump.

It is an object of the present invention to apply this principle to a fuel-injection internal combustion engine, which comprises a multi-cylinder single-housing injection pump, which comprises an injection pump having a single housing and several cylinders containing fuel-injection plungers rigidly connected to their operating tappets which themselves are imparted a reciprocating movement by the cams of a cam shaft contained in the injection pump housing.

The present invention therefore provides a method of stopping, in case of overspeed, and internal combustion engine comprising at least one fuel-injection pump of the constant-stroke reciprocating plunger type, the said method consisting, in case of overspeed, in supplying a compressed gaseous fluid such as air or an inert gas under a sufficient pressure into the pump body and in causing the said pressure to act upon the pump plunger to lift and disengage the same from its operating means to thereby stop the injection pump, characterized in that the injection pump is of the multi-cylinder single-housing type comprising a cam shaft whose cams impart a reciprocating movement to tappets associated with the plungers of the various cylinders, each plunger being slidably and substantially sealingly mounted in the corresponding cylinder, and in that the said compressed gas is supplied to the pump housing to thereby simultaneously lift all the plungers and separate them from their operating cams.

The method according to the invention therefore allows the injection of fuel into the engine to be completely stopped by means of a single operation and a single injection of compressed gas into the injection pump housing, by retaining the injection pump plungers in an upper position in which they are separated from the operating means serving to impart them a reciprocating movement.

The invention also provides a device for carrying out the method of the invention, which is characterized in that the injection pump is of the multi-cylinder single-housing type comprising a cam shaft whose cams impart a reciprocating movement to tappets associated with the plungers of the various cylinders, each plunger being slidably and substantially sealingly mounted in the corresponding cylinder, and in that the pump housing is connected to a source of compressed gas such as air or an inert gas through a hand-operable and/or automatically actuated stop or shut-off cock or valve means.

The invention will be better understood and other purposes, characterizing features, details and advantages of the latter will appear more clearly as the following explanatory description proceeds with reference to the appended diagrammatic drawing given solely by way of example illustrating one form of embodiment of the invention and wherein:

The single FIGURE is a diagrammatic sectional view of a fuel-injection pump to which the present invention is applied.

The multi-cylinder single-housing fuel-injection pump may be of the type with in-line cylinders (as shown in the drawing) or with cylinders in V-arrangement. The pump comprises essentially a single housing 10 containing a cam shaft 12 each cam 14 of which co-operates with the cam follower 16 of a tappet 18 rigidly connected to a fuel-injection plunger 20 slidably reciprocating in a cylinder 22 secured on the injection pump housing 10 by means which are not shown.

In the example illustrated, the housing 10 is thus associated with several, longitudinally aligned cylinders 22, each containing an injection plunger 20 associated with a tappet 18.

Each plunger 20 comprises, in a known manner, a helical groove 24 for controlling the amount of fuel to be injected at each stroke of the plunger, and the angular position of which is adjusted by rotating the plunger about its axis by means of, for example, a toothed rack member 26 extending longitudinally in the cylinders 22 and serving to rotate all the plungers 20.

A return spring 28 associated with each tappet 18 urges the same downwardly into contact with the corresponding cam 14 and bears at its upper end upon a shoulder or abutment in the cylinder 22 and at its lower end upon the upper portion of the tappet 18. The tappet 18 comprises an upper cylindrical sleeve portion 30 provided with a longitudinal slot or cut 32 in which is engaged the dog point or teat 34 of a screw 36 srewed in a hole extending through the wall of the upper portion of the housing 10 in the region of the sleeve portion 30. Each tappet 18 is thus guided in longitudinal reciprocating movement while at the same time being prevented from rotating about its axis. As will be seen later the dog point 34 of the screw 36 also serves to limit the upward displacement, in case of emergency stopping, of the tappet 18 and therefore the plunger 20.

Each tappet 18 also comprises a sealing ring 38 so that each tappet 18 is mounted slidably and at least partially sealingly in the upper portion of the housing 10.

It will be noted that the internal space of the lower portion of the housing 10 containing the cam shaft 12 extends all along the injection pump and that upper chamber 40 defined between the upper portion of the housing 10 and the lower portion of each cylinder 22 and containing the spring 28 is common to all the cylinders 22.

The device for emergency stopping in case of overspeed also comprises a source 42 of compressed gas such as air or an inert gas under pressure, which is connected through a line 44 and a three-way cock or valve 46 to an oil-overflow line opening into the lower portion of the housing 10, as shown in the drawing. The three-way cock 46 may be operated manually and/or actuated automatically by a tripping device 50 sensitive to engine overspeed or racing.

The injection pump just described also comprises means allowing the chamber 40 to be communicated with the open air, for example through a calibrated or check valve 52 whose outlet from the cylinder 22 may be connected through a line 54 to the oil-overflow line 48 downstream of the three-way cock 46.

The normal operation of the above-described injection pump is well known and will therefore be recalled here only briefly. As a result of rotation of the cam shaft 12, the cam 14 imparts a reciprocating movement to the tappet 18 and therefore to the plunger 20 of the injection pump. The control of the amount of fuel injected at each stroke of the plunger is obtained by means of the toothed rack 26 which causes all the plungers 20 to rotate simultaneously about their axes to impart to the helical groove 24 predetermined angular positions relative to the fuel intake and discharge ports in the usual manner. Each tappet 18 is prevented from rotating about its axis by the dog point 34 of the screw 36, whereas each plunger 20 is jointly movable in the longitudinal direction with its tappet 18 but is free to rotate relative to the latter.

In case of engine overspeed or racing resulting for example from a seizing or jamming of the toothed rack 26 in the position of adjustment of the maximum amount of fuel injected at each stroke of the pistons 20, the three-way cock 46 is either operated manually or actuated automatically by the tripping device 50 to cause the source of compressed gas 42 to communicate with the interior of the housing 10. The compressed gas entering the housing 10 fills it up and acts upon the lower surface of the tappets 18 to cause them to move upwardly against the action of their return springs 28. The dog point 34 of each screw 36 restricts the upward movement of the tappet 18, so that each tappet 18 is separated from its operating cam 14 and the upper portion of the plunger 20 does not butt against the valve seat provided in the upper portion of each injection cylinder 22.

Thus, the compressed gas entering the housing 10 causes all the tappets 18 and therefore all the plungers 20 to be lifted to a position in which they are no longer acted upon by the operating cams 14. The operation of the injection pump is thus discontinued and the engine stops.

To restore the normal operating condition of the device, the cock 46 is returned to its initial position in which the oil-overflow line 48 is cut off from the source of compressed gas 42.

The check valve 52 calibrated at a low value prevents the building up of an overpressure within the chamber 40 as a result of compressed gas leakage along the tappets 18 despite the presence of the sealing rings 38.

Of course the invention is by no means limited to the form of embodiment described and illustrated which has been given by way of example only. In particular, it comprises all means constituting technical equivalents to the means described as well as their combinations should the latter be carried out according to its gist and used within the scope of the following claims.

What is claimed is:

1. A method of stopping a fuel-injection internal combustion engine in case of overspeed, the engine having at least one injection pump, said pump including a single pump housing having a plurality of cylinders, a constant-stroke reciprocating piston in each cylinder, a plurality of tappets for driving said pistons, a camshaft having a plurality of cams for driving said tappets, said camshaft being located in one part of the pump housing which is sealingly separated by said tappets from the rest of the pump housing, and an oil overflow line connected to the one part of the housing, wherein the method comprises:

providing a source of pressurized gas, sensing the speed of the engine, and, in case of overspeed, feeding pressurized gas into the one part of the housing through the oil overflow line to lift said tappets out of contact with their driving cams.

2. A method according to claim 1, further consisting in limiting the movement of each tappet from its driving cam.

3. A device for stopping a fuel-injection internal combustion engine in case of overspeed, the engine having at least one injection pump, said pump including a pump housing having a plurality of cylinders, a pump piston in each cylinder, a plurality of tappets for driving said pistons, a camshaft having a plurality of cams for driving said tappets, the camshaft being located in one part of the pump housing and sealingly separated from the rest of the pump housing, and an oil overflow line connected to the one part of the housing, wherein the improvement comprises:

a source of pressurized gas and means for selectively connecting said source to said oil overflow line in case of overspeed to feed pressurized gas into the camshaft housing to lift said tappets out of contact with their driving cams.

4. A device according to claim 3, wherein said means for selectively connecting said source to said oil overflow line comprises a three-way cock connected between said source and said oil overflow line.

5. A device according to claim 3 further comprising a plurality of stationary pins, each pin being associated with one of said tappets for guiding the tappet in translation and preventing it from rotating, each of said stationay pins further constituting a stop means for restricting the movement of the corresponding tappet from its driving cam in response to the pressure of pressurized gas supplied into the camshaft housing.

6. A device according to claim 3, wherein the pump housing further comprises a chamber communicating with at least one of the pump cylinders above the camshaft housing, and venting means for allowing the exhaust of pressurized gas leaking from said camshaft housing into said chamber.

7. A device according to claim 6, wherein said chamber is common to at least two of the pump cylinders.

* * * * *